United States Patent [19]

Weisweiler et al.

[11] Patent Number: 4,971,673

[45] Date of Patent: Nov. 20, 1990

[54] COATING FIBERS WITH A LAYER OF SILICON

[75] Inventors: Werner Weisweiler, Remchingen; Gerd Nagel, Ludwigshafen, both of Fed. Rep. of Germany

[73] Assignee: BASF Aktiengesellschaft, Fed. Rep. of Germany

[21] Appl. No.: 376,925

[22] Filed: Jul. 10, 1989

Related U.S. Application Data

[63] Continuation of Ser. No. 155,700, Feb. 16, 1988, abandoned.

[30] Foreign Application Priority Data

Feb. 26, 1987 [DE] Fed. Rep. of Germany ..... 3706218

[51] Int. Cl.[5] ..... C23C 14/40

[52] U.S. Cl. ..... 204/192.15; 204/192.14; 204/192.23

[58] Field of Search ..... 204/192.15, 192.16, 204/192.22, 192.23, 192.14

[56] References Cited

U.S. PATENT DOCUMENTS

| | | | |
|---|---|---|---|
| 3,627,663 | 12/1971 | Davidse et al. | 204/192.15 |
| 4,209,375 | 6/1980 | Gates et al. | 204/192.15 X |
| 4,309,261 | 1/1982 | Harding et al. | 204/192.15 |
| 4,414,085 | 11/1983 | Wickersham et al. | 204/192.15 |
| 4,525,417 | 6/1985 | Dimigen et al. | 204/192.15 X |
| 4,544,468 | 10/1985 | Munz et al. | 204/192.15 X |
| 4,581,289 | 4/1986 | Dietrich et al. | |
| 4,619,865 | 10/1986 | Keem et al. | 204/192.15 X |

FOREIGN PATENT DOCUMENTS 60-119222 6/1985 Japan .

*Primary Examiner*—Nam X. Nguyen

*Attorney, Agent, or Firm*—Burns, Doane, Swecker & Mathis

[57] ABSTRACT

The invention relates to a continuous process for coating bundles of fibers, particularly carbon fibers, with a layer of silicon—which may be present as the carbide, oxide, nitride, or plasma polymer with carbon and hydrogen or in elementary form—by radio-frequency sputtering. The coated fibers are suitable in particular for the manufacture of reinforced plastics.

8 Claims, 1 Drawing Sheet

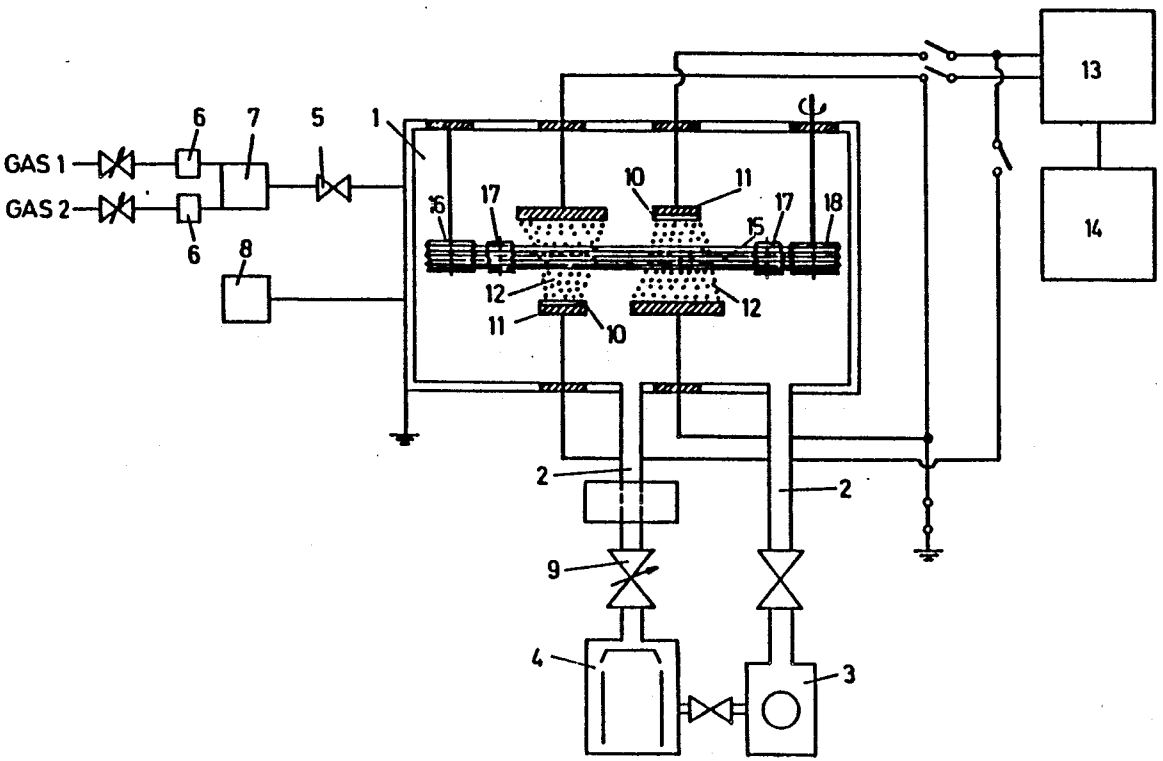
13
14
18
17
15
11
12
10
10
12
11
17
15
1
5
7
6
6
8
GAS 1
GAS 2
2
2
9
3
4

COATING FIBERS WITH A LAYER OF SILICON

This application is a continuation of application Ser. No. 155,700, filed Feb. 16, 1988 abandoned.

BACKGROUND OF THE INVENTION

The present invention relates to a process for coating fibers with a thin, surface-protective, adhesion-promoting layer of silicon by means of sputtering.

At higher temperatures carbon fibers are not generally stable in contact with metals that form carbides, such as aluminum, so if they are intended to reinforce such metals they must be provided with a protective diffusion barrier before being embedded in the metal matrix. Protective layers are also necessary for fibers that are exposed to oxidizing media, especially at higher temperatures. Silicon carbide provides a suitable protective surface layer, being chemically stable to metals, resistant to abrasion, light, and resistant to oxidation and having low thermal expansivity.

It is known that carbon fibers are treated by various methods of forming surface-active groups before being embedded as reinforcement in matrices of synthetic resins; these groups, which improve adhesion between the fiber and the polymer matrix, can for instance be formed by superficial thermal, wet, or electrochemical oxidation. Besides methods of superficial oxidation, processes for forming polymer coatings are also known; they comprise radiation-induced graft reactions and electropolymerization at the surface of the fiber, which can be carried out anodically or cathodically. The polymer coating promotes adhesion between fiber and matrix.

Many processes for coating carbon fibers are known, but coating from the gas phase by the process known as chemical vapor deposition (CVD) is the one used most often.

These processes have the disadvantage that the temperature of the substrate has to be between 800° C. and 1200° C. if it is to be coated with a layer of silicon carbide, and are hence suitable solely for coating carbon or silicon carbide fibers. Because of the necessity of using high temperatures there is only a limited possibility of influencing the morphology and structure of the coating, and hence its chemical, physical, and mechanical properties and its adhesion to the surface of the fiber.

The use of vaporization processes for coating fibers with silicon carbide (which necessarily involve a chemical reaction: silicon reacts with an atmosphere of hydrocarbon) requires that the individual filaments in a bundle of fibers should be first spread out mechanically, since the stream of particles emitted by the vapor source is only slightly dispersed geometrically. In addition, the reactive components must be activated by high substrate temperatures or by the use of a plasma.

German Patent No. C 32 49 624 describes the manufacture of fibers with a superconducting layer of a niobium compound by the reactive direct-current sputtering of niobium. Here too the bundle of fibers had to be spread out mechanically, which led to the rupture of fibers.

Japanese Patent No. A 119 222/85 describes carbon fibers with a refractory coating, silicon carbide for instance. The coating is preferably applied by chemical vapor deposition (CVD); other methods, such as sputtering, are mentioned without any details.

The object of the present invention was to provide a technically simple process for coating reinforcing fibers with a surface-protective, adhesion-promoting layer of silicon, this process allowing many individual fibers in a bundle of fibers to be homogeneously coated at the same time.

We have found that this object is achieved if the coating is applied by radio-frequency sputtering.

SUMMARY OF THE INVENTION

A continuous process is provided for simultaneously coating many individual fibers gathered in a bundle with a layer of silicon which may be present as the carbide, oxide, nitride, or plasma polymer with carbon and hydrogen or in elementary form by means of radio-frequency sputtering wherein during the process the individual fibers which initially are gathered in close contact within the bundle are passed in the direction of their length in the absence of mechanical spreading through a radio-frequency sputtering zone wherein the fibers of the bundle are caused to repel each other and a substantially homogeneous coating of the silicon is deposited on the surfaces of the individual fibers of the bundle.

BRIEF DESCRIPTION OF THE DRAWING

The drawing illustrates a representative apparatus arrangement which may be used to practice the improved process of the present invention wherein silicon is deposited on the surfaces of the individual fibers of a fiber bundle.

DESCRIPTION OF PREFERRED EMBODIMENT

The principle of sputtering is known. In this process gas-discharge is maintained in an inert-gas plasma between a pair of electrodes; positively charged inert-gas ions formed by collisions are accelerated in the electric field towards the cathode, which they strike with an energy of several thousand electronvolts. The impacts remove from the surface of the cathode both secondary electrons, which help maintain the gas discharge, and some of the cathodic material. Mainly neutral particles of the latter diffuse into the gas-filled space and strike the fibers there with an energy of a few electronvolts, gradually forming a continuous layer on the surfaces of the fibers.

The apparatus and methods for the industrial use of sputtering are given, for instance, in *Vakuumtechnik*, 1–11 (1975).

In direct-current sputtering the coating of geometrically complicated substrates such as bundles of fibers is made difficult by mutual screening of individual fibers from the unidirectional stream of particles. Because the particles to be deposited do not disperse readily the individual fibers cannot be coated simultaneously by direct-current sputtering unless the bundle of fibers is fanned out mechanically.

The novel process solves this problem by means of radio-frequency sputtering. In the applied alternating field considerably more electrons reach the silicon or silicon carbide electrode during the positive half of the cycle than ions during the negative half, since the electrons are more mobile. Silicon or silicon carbide is only a semiconductor, that is to say, it acts as a dielectric and its surface becomes negatively charged; thus it becomes a cathode, and the applied alternating field is overlain by a direct-current potential gradient. Sputtering then occurs through the action of this gradient, as described above. The filaments making up the fibers, which normally are in close contact with one another, become electrically charged in the radio-frequency plasma and repel each other mutually. In this way the surfaces of filaments right inside the bundle of fibers are reached by sputtered particles, which are deflected by plasma particles and the surface of the fibers, and become coated by an unbroken, homogeneous layer.

A particular advantage of the novel process is that it offers the possibility of reactive sputtering. For this, one or more components that react chemically with the sputtered cathode material are introduced into the inert-gas plasma. For instance, if the cathode is of silicon and hydrocarbons are introduced into the plasma, coatings of the molecular formula $Si_xC_yH_z$ can be formed, depending on the kind and concentration of hydrocarbon and the performance of the sputterer; the properties of these coatings lie between those of silicon, silicon carbide, and silicon-carbon-hydrogen plasma polymers. Introduction of other reactive gases, such as oxygen or nitrogen, allows the deposition of other compounds—oxides or nitrides in this instance. It is also possible to achieve chosen concentration gradients at the interface between fiber and coating. For instance, a layer of silicon can be deposited first and followed by a layer of silicon carbide.

Conventional sputtering arrangements allow at the most coating rates of several nanometers per minute; distinctly faster deposition can be obtained by the use of an extra magnetic focussing field. Magnetron sputterers apply a magnetic field perpendicular to the usual direction of electron movement; this constrains the electrons to follow spiral paths about the field direction, which increases the distances travelled and the probability of ionization occurring, thereby enabling higher sputtering rates.

The cathode material can be either alpha-SiC, which sputters as such and deposits on the fibers, or silicon, which can if required react with additives to the plasma, causing deposition of reaction products on the fibers.

Carbon is the preferred material for the fibers, but the novel process also allows the formation of coatings on fibers made of glass, silicon carbide, boron, steel, or polymers such as aromatic polyamides or polypropylene. The fibers are treated in the form of bundles, which may consist of several thousand individual filaments. It is practical to coat several bundles of fibers at the same time, taking them off one set of spools, passing them through the plasma and coating them, and winding them again onto a second set of spools. The coating can be carried out with several cathodes in succession, adjacent cathodes being offset by 180° or 120° (for three cathodes). The electrodes are generally between 2 cm and 10 cm apart; their size and shape can be chosen at will, depending on the geometry of the substrate to be coated.

Radio-frequency sputtering in accordance with the novel process can be carried out with a frequency of about 10 kHz or more, but frequencies greater than 10 MHz are preferred. In the Federal Republic of Germany the Post Office permits the use of the frequencies 13.56 MHz and 27.2 MHz. The maximum attainable power density is about 20 W/cm$^2$, but in practice the working level is about 10 W/cm$^2$.

The attainable thicknesses of the coating can vary between wide limits, from 5 nm to 1000 nm, but thicknesses of from 10 nm to 100 nm are preferred.

The equipment is shown in the drawing. The coating chamber 1 is evacuated through the tubulures 2 by the backing pump 3 and the diffusion pump or turbomolecular pump 4 to a pressure of less than 1 mPa. An inert gas—usually argon—is admitted into the chamber through the inlet valve 5 and the flowmeter 6; this gas is called the plasma or working gas. A reactive gas for reactive sputtering can be mixed with the working gas in the mixing chamber 7, into which it passes via a second flowmeter 6; the composition of the mixture is determined by means of the quadrupole mass spectrometer 8. The working pressure in the coating chamber, which is decided by the sputtering process and the distance between electrodes and may be, for example, from 100 mPa to 2000 mPa, can be kept constant by steadily pumping out through the butterfly valve 9 and admitting just enough gas through the inlet valve 5 to establish the required pressure.

The target material 10, silicon carbide or silicon, for example, is bonded to the water-cooled stainless steel cathodes 11, which are electrically insulated from the walls of the coating chamber. To start sputtering of the target a low-pressure plasma 12 is established, the necessary energy being supplied by the radio-frequency generator 14, which is connected to the electrodes 11 via the matching network 13 and coaxial leads. The plasma itself serves as the source of ionization for the gases used for sputtering. The bundles of fibers 15 are led through the plasma 12 at a distance of from 3 cm to 6 cm from the surfaces of the targets, being taken from spools 16, which are outside the plasma zone and electrically insulated from the walls of the coating chamber, and guided by idler rolls 17 The bundles of fibers within the plasma encounter particles that have been removed from the target surfaces by bombardment with ions, and these particles build up into a coating. The coated fibers are wound up on the spools 18, which are driven electromechanically from the outside via a shaft passing through a vacuum-tight seal. The texture of the coating and its adhesion to the substrate are highly dependent on the surface temperature of the substrate, so provision is made for heating the bundles of fibers before they are coated by means of the infrared heaters 19.

Fibers coated by the novel process show better adhesion to matrices of synthetic resins. Coated carbon and silicon carbide fibers display better resistance to oxidation.

The improved resistance to oxidation is seen from the figures in Table 1. Carbon fibers (HTA 7 from Messrs Toho Rayon) were coated with different thicknesses of silicon carbide and heated to a temperature of 900° C. at a rate of 10 K/min; the losses in mass were determined gravimetrically.

TABLE 1

| Thickness of coating/nm | Relative decrease in mass/% |
|---|---|
| 0 | 83.5 |
| 50 | 51.5 |
| 100 | 50.5 |
| 300 | 40.3 |
| 500 | 36.9 |

Fibers coated by the novel process can be used for the reinforcement of ceramics and metals, but are especially suitable for the manufacture of reinforced plastics. The plastic component can be any of the usual thermoplastics or thermosetting resins.

Table 2 shows the improved mechanical properties of an epoxy resin reinforced with coated fibers. Reinforced materials were made from a commercial epoxy resin and 60% by volume of reinforcing fibers made from carbon (HTA 7 from Messrs Toho Rayon) or silicon carbide (Nicalon from Nippon Carbon Co.) that had been coated with various thicknesses of silicon carbide. The properties were measured by the following methods:

| | |
|---|---|
| Interlaminar shear strength (ILSS) | ASTM D 2344-76 |
| Flexural strength | Methods based |
| Tensile strain at break | DIN 53 452 |

TABLE 2

| Fiber | Thickness of coating/nm | ILSS /MPa | Flexural strength/MPa | Tensile strain/% |
|---|---|---|---|---|
| Carbon | — | 73.4 | 1885 | 1.44 |
| | 9 | 86.7 | 1975 | 1.61 |
| | 21 | 84.4 | 1961 | 1.63 |
| | 73 | 93.0 | 1962 | 1.59 |
| Silicon carbide | — | 30.4 | 1073 | 0.83 |
| | 50 | 70.3 | 2118 | 1.52 |

We claim:

1. A continuous process for simultaneously coating many individual fibers gathered in a bundle with a layer of silicon which may be present as the carbide, oxide, nitride, or plasma polymer with carbon and hydrogen or in elementary form by means of radio-frequency sputtering wherein during said process the individual fibers which initially are gathered in close contact within the bundle are passed in the direction of their length in the absence of mechanical spreading through a radio-frequency sputtering zone wherein the fibers of the bundle are caused to repel each other and a substantially homogeneous coating of said silicon is deposited on the surfaces of the individual fibers of the bundle.

2. A process as claimed in claim 1 wherein silicon carbide is removed from an alpha-SiC cathode by bombardment with ions and deposited on the fibers.

3. A process as claimed in claim 1 wherein silicon is removed from a silicon cathode by bombardment with ions, forms silicon carbide or a silicon-carbon-hydrogen plasma polymer by reaction with a hydrocarbon in an inert-gas plasma, and as such is deposited on the fibers.

4. A process as claimed in claim 1 wherein the coating is carried out with two cathodes offset by 180° or three cathodes offset by 120°.

5. A process as claimed in claim 1 wherein one or more bundles of fibers are taken off spools, led through the sputtering zone and coated, and wound onto other spools.

6. A process as claimed in claim 1 wherein sputtering is carried out with a frequency greater than 10 kHz and preferably greater than 10 MHz.

7. A process as claimed in claim 1 wherein sputtering is carried out in a magnetic focussing field.

8. A process as claimed in claim 1 wherein fibers made from carbon, glass, silicon carbide, aluminum oxide, boron, steel, or polymers are coated.

* * * * *